United States Patent [19]

Kuehnle

[11] 3,958,162

[45] May 18, 1976

[54] METHOD AND APPARATUS FOR CHARGING AN ELECTROPHOTOGRAPHIC MEMBER

[75] Inventor: Manfred R. Kuehnle, Lexington, Mass.

[73] Assignee: Coulter Information Systems, Inc., Bedford, Mass.

[22] Filed: Jan. 17, 1975

[21] Appl. No.: 541,708

[52] U.S. Cl. ..... 317/262 A; 250/326

[51] Int. Cl.² ..... H01T 19/00

[58] Field of Search ..... 317/262 A; 250/324–326

[56] References Cited

UNITED STATES PATENTS

| | | | |
|---|---|---|---|
| 3,233,156 | 2/1966 | Jarvis et al. | 317/262 A |
| 3,385,966 | 5/1968 | Rosenthal | 250/325 |

*Primary Examiner*—J. D. Miller
*Assistant Examiner*—Harry Moose
*Attorney, Agent, or Firm*—Silverman & Cass, Ltd.

[57] ABSTRACT

A method for charging an electrophotographic member which includes rotating a number of elongate corona electrodes, which are positioned parallel to and a predetermined distance from a central axis, about the central axis while simultaneously applying a corona voltage to each of the electrodes whereby each develops a corona, so that a substantially uniform corona charge is applied to the entire electrophotographic member. An additional step, performed simultaneously with production of the corona and rotation of the electrodes, can be the movement of one of the rotating electrodes and the electrophotographic member relative to the other with a predetermined distance being maintained between the member and central axis. Apparatus employed to perform this method also is disclosed.

32 Claims, 4 Drawing Figures

METHOD AND APPARATUS FOR CHARGING AN ELECTROPHOTOGRAPHIC MEMBER

BACKGROUND OF THE INVENTION

This invention relates to a method and apparatus for applying a uniform electrical charge to a structure, and more particularly to a method and apparatus for applying a uniform corona produced charge to an electrophotographic member or imaging surface.

It is well known that in electrostatic printing equipment a corona generating device including a corona discharge electrode is employed to place positive or negative charges onto a photoconductive member or surface. The photoconductive member or surface is then exposed to a pattern of light which corresponds to the image to be printed. The pattern of light will discharge the photoconductive surface selectively in accordance with the presence and intensity of the light creating an electrostatic image of the light pattern on the surface. This electrostatic image may be employed in a number of ways now well known in the art in order to reproduce an image on a sheet of paper, or in some instances, the surface or member may be fixed in order to reproduce the electrostatic image.

The nature of photoconductive member is such that it will retain the charge deposited thereon for a very short time period, and only then if maintained in a darkened environment. If it takes some period of time for the charge to be applied to the member the level or intensity of the charging process will have decayed or reduced as compared to the charge level applied at the end of the charging process. If the lighted image is exposed after the entire charging process the electrostatic image produced may be nonuniform as a result of this variation in charge level.

The corona generated in the above noted devices could be positively or negatively biased either in order to produce a positive or negative charge depending upon the nature of the photoconductive surface employed. When a positive corona is generated from a metallic filament electrode, the resultant charge applied to the photoconductive surface is generally relatively uniform due to the uniformity of the positive corona electrode emission. Many of the more currently available devices require a negative corona. When a negative corona is generated from a metallic filament electrode, the photoconductive surface obtains a charge which varies in density from point to point due to the nonuniform negative corona electrode emission. It is believed that this nonuniformity in charge is manifest in the developed image since areas containing a higher charge will attract more electrostatic developer material thereto thereby creating a streaked image appearance.

A number of devices have been developed in order to provide a uniform charge on the desired photoconductive surface. One such device employs specially coated electrodes which suppress the widely spaced emission nodes common to negatively biased corona electrode emissions. Another device moves the metallic corona electrode and the surface being charged substantially in orthogonal directions. Still other devices employ alternating currents plus a high voltage direct current to minimize or reduce the nonuniformity. These devices appear to provide a more uniform charge for the above equipment. It should be noted, however, that the above mentioned equipment generally is rather limited in its photographic reproduction capabilities to reproducing printed matter, because of the nature of the photoconductive surfaces employed.

Electrophotographic members are being developed which are much more sensitive than the members employed in the above noted equipment. These electrophotographic members are of a quality capable of reproducing or creating high resolution images, that is, each point on the surface of the member is capable of selectively discharging in accordance with the intensity of incident light so that an almost infinite scale of grey tones can be reproduced in the resultant image. In order to make full use of this feature, the applied corona charge must be substantially uniform across the entire member or surface of the member. This is necessary in order to produce a resultant image which has varying shades that result from variations in the intensity of incident light and not from variations in the initial corona produced charge.

SUMMARY OF THE INVENTION

In practicing this invention a method for charging an electrophotographic member or surface is provided which includes rotating a number of elongate corona electrodes, which extend parallel to a central axis, about the central axis. A corona voltage is applied to the rotating electrodes to develop a corona about each. The rotating corona electrodes and the electrophotographic member or surface are moved relative to one another with a predetermined distance being maintained between the member and the central axis so that a substantially uniform corona charge will be applied to the entire electrophotographic member or surface.

An apparatus is also provided which includes a corona producing device which has a number of elongate spaced apart corona electrodes each having an axis extending parallel to a central axis and positioned radially therefrom. A first drive device is coupled to the corona producing device and is operative to rotate the electrodes about the central axis. A second drive device is coupled to either the corona producing device or the electrophotographic member for moving one relative to the other during rotation of the electrodes so that a substantially uniform corona charge may be applied to the electrophotographic member or surface.

DETAILED DESCRIPTION OF THE PREFERRED EMBODIMENT

Figures 1, 2, 3, 4:
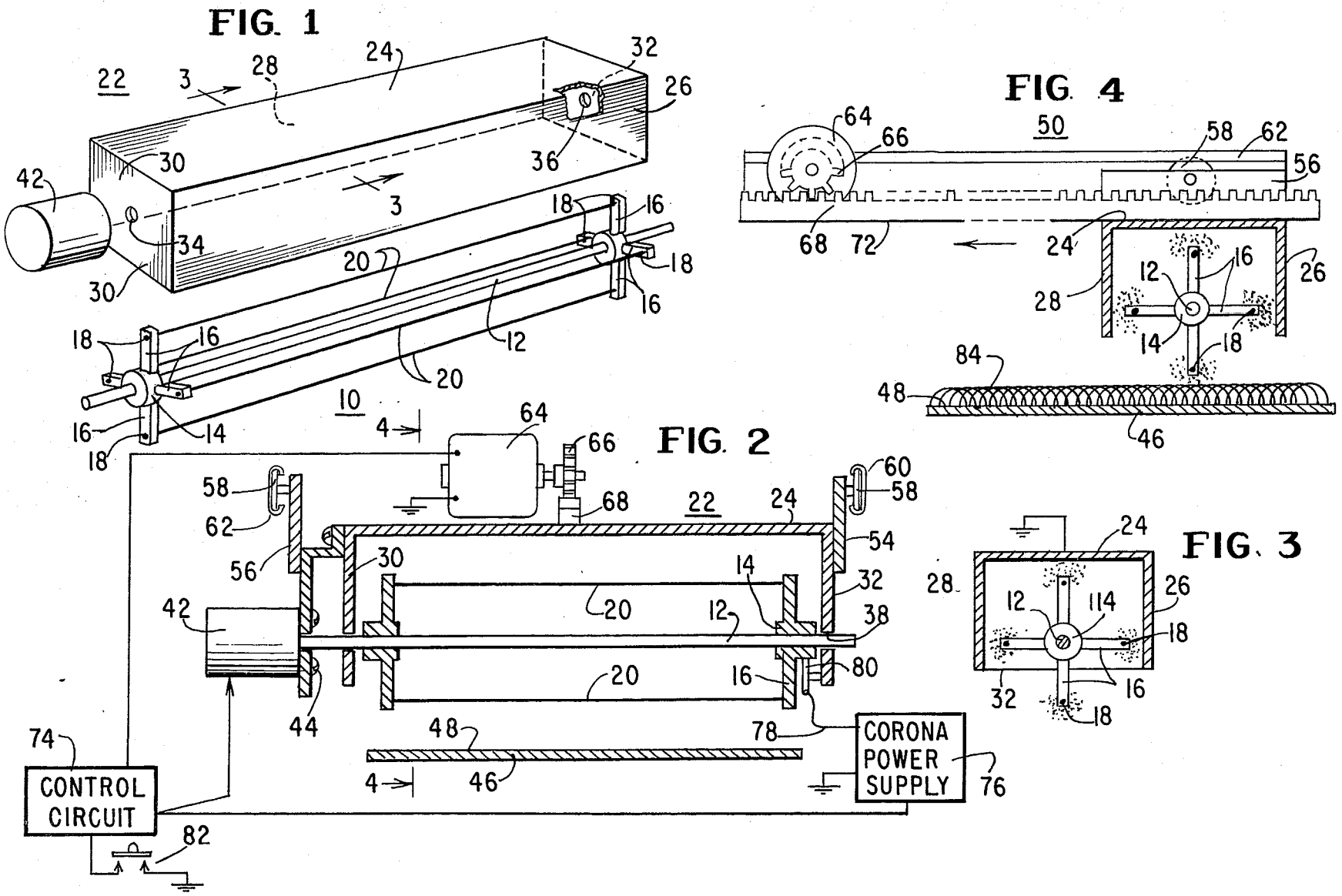
FIG. 1 is an exploded perspective view of certain portions of the apparatus of the invention.
FIG. 2 is a somewhat diagrammatic sectional view of the corona discharge apparatus of this invention and an electrophotographic member to be charged, and a partial block diagram of the associated electronic equipment.
FIG. 3 is a sectional view taken generally along the line 3—3 of FIG. 1, and in the direction indicated.
FIG. 4 is a side view, partially in section, of the corona discharge apparatus of the invention and the electrophotographic member to be charged, taken along the line 4—4 of FIG. 2.

Referring first to FIG. 1, a corona producing device, generally identified by the numeral 10, is shown and includes a central rod 12 which is formed from a synthetic resin such as tetrafluorethylene or some other nonconductive material and has a diameter of approximately 0.125 inches. Electrode support arms 14 are fixed to the rod 12 adjacent each end thereof. Four support fingers 16 are formed on each electrode support arm 14. These support fingers extend radially outward from the axis of rod 12, each set of four being generally in a plane normal to the rod. Support fingers 16 are purposely made somewhat thin in order to render them flexible. In the preferred embodiment, support fingers 16 are 90° apart. A small aperture 18 is formed in each support finger 16 adjacent its distal end. The fingers 16 on electrode support arm 14 at one end of rod 12 are aligned with respect to the fingers 16 of the electrode support arm 14 secured to the other end of rod 12. Electrode support arms 14 and support fingers 16 are formed from an electrically conductive material.

Corona electrodes 20 in the form of metal wires, stretched taut, are secured between the support fingers, there being one such electrode between each pair of opposite aligned fingers 16. The ends of the electrodes pass through the apertures 18 of the fingers to which the said electrodes 20 are secured. Tautness is maintained by reason of the flexibility of the support fingers 16 which are stressed slightly when the electrodes 20 are assembled to the device 10.

A housing 22, best shown in FIG. 1, includes a top wall 24, side walls 26 and 28, and end walls 30 and 32. An aperture 34 is formed in end wall 30 and an aperture 36 is formed in end wall 32. A bottom wall is not provided so that the walls of housing 22 define a shallow hood or cavity.

Corona producing device 10 is mounted into housing 22 with the ends of the rod 12 journalled in apertures 34 and 36. This may best be seen by reference to FIG. 2. Rod 12 is rotatable in apertures 34 and 36 so that electrodes 20 are rotatable about the axis of rod 12. Apertures 34 and 36 may have anti-friction bearings 38.

Support arms 14 and support fingers 16 are positioned within the hood or cavity formed by housing 22 as can best be seen in FIGS. 2 and 3. The length of fingers 16 is such that corona producing device 10 may rotate freely within housing 22 without fingers 16 and electrodes 20 contacting the inner surfaces of any of the side or top walls, while allowing the fingers to extend slightly beyond the opening formed by the edges of side walls 26 and 28 and end walls 30 and 32 as best seen in FIG. 3.

Referring now to FIG. 2, a motor supporting arm 40 is illustrated secured to the side wall 30 of the housing 22. A fractional horsepower motor 42 is mounted on the arm 40 and coupled to an end of the rod 12 of the corona producing device through an aperture 44. Motor 42 is energized by an suitable power source, such as for example, a low voltage source included in the control circuit 74.

The electrophotographic member to be charged by the apparatus of this invention is identified by the reference numeral 46 and is illustrated in FIGS. 2 and 4. The upper coating 48 of member 46 is to be charged. As noted previously, member 46 may be moved relative to device 10 during charging or device 10 may be moved relative to member 46. For purposes of this description only it shall be assumed that member 46 remains fixed and that corona producing device 10 is moved relative thereto.

Referring again to FIGS. 2 and 4, a moving assembly 50 is shown including a support arm 54 secured to side

32 of housing 22 and a support arm 56 secured to motor supporting arm 40. Support arms 54 and 56 extend upwardly beyond side wall 24 of housing 22. Rollers 58 are secured to arms 54 and 56 adjacent their upper ends, these rollers 58 being supported in guide tracks 60 and 62 secured to the side walls of a housing in which the entire apparatus is mounted. A motor 64 is shown positioned adjacent the ends of guide tracks 60 and 62. Although the motor is not shown mounted, it is assumed that the motor may be mounted to some portion of the housing for this apparatus. A gear wheel 66 is shown secured to the end of the motor drive shaft. Gear wheel 66 meshes with the gear teeth 68 formed on the top surface of gear arm 70. The bottom surface 72 of gear arm 68 is secured, at one end of arm 68 thereof to top wall 24 of housing 22. A control circuit 74 is coupled to motor 64 and to motor 42 for supplying operating power to both motors. Control circuit 74 is also coupled to a corona power supply 76, which develops the voltage necessary to create the corona about corona electrodes 20, in order to initiate and terminate operating of the corona power supply. Corona power supply 76 is coupled to the electrode supporting arm 14 via conductor 78 and brush 80 which maintains electrical contact with supporting arm 14 while it is rotating. As previously noted, supporting arm 14 is electrically conductive so that the corona voltage is coupled from power supply 76 via conductor 78, brush 80, supporting arm 14 and support fingers 16 to electrodes 20 for developing the desired corona. Operation of control circuit 74 is initiated by actuation of pushbutton switch 82.

In operation, pushbotton switch 82 is depressed actuating control circuit 74. Control circuit develops a first control signal when actuated which is coupled to corona power supply 76 initiating operation of corona power power supply 76 and maintaining its operation for the period necessary to completely charge the surface of member 46. This voltage, as previously noted is coupled via conductors 78, brush 80, supporting arm 14 and support fingers 16 to electrodes 20 developing a corona of negatively charged particles about each one of electrodes 20. If housing 22 remains ungrounded, the entire inner area defined by housing 22 will become filled with charged particles produced by the corona from each of the four corona electrodes 20 shown in the preferred embodiment. If, however, housing 22 is grounded, as for example, as shown in FIG. 3, the charges developed by three of the four electrodes will be dissipated and a corona of charged particles only will be maintained about the electrode adjacent the open side of housing 22.

As soon as corona power supply 76 has developed its full voltage control circuit 74 will develop a second control signal which is coupled to motor 42 initiating its operation. In the preferred embodiment, motor 42 is rated at one-hundredth horsepower, 5 watts and will rotate at 1200 rpm. The rotation of motor 42 will cause rotation of rod 12 in corona producing device 10 resulting in a rotation of all four electrodes 20 about the central axis passing through rod 12 at a rate of 1200 rpm. This will bring each corona electrode adjacent the open side of housing 22 for a short period of time.

When motor 42 has begun rotating control circuit 72 will develop a third control signal which is coupled to motor 64 initiating its operation. Motor 64 will turn gear wheel 66 causing gear arm 70, housing 22 and corona producing device 10 to move linearly along guide tracks 60 and 62 to the end thereof in the direction shown by the arrow in FIG. 4 while being maintained at a predetermined distance about the surface 48 of electrophotographic member 46. Motor 64 is a reversing motor and another control signal from control circuit 74 will cause it to reverse at the end of its forward movement and return to its original or starting position.

The height maintained is established such that each electrode as it rotates will pass close enough to surface 48 to deposit the corona charges thereon for charging the plate. The linear horizontal movement of device 10 and housing 22 is much slower than the rotational speed of device 10. However, the speeds are both selected such that as an electrode rotates and passes adjacent surface 48, it will deposit corona charges overlapping the charges deposited by a previously passing electrode. The following electrode will deposit charges on surface 48 which overlap the charges deposited by the preceding electrode. This overlappig process is represented in FIG. 4 at 84. By rotating a number of different electrodes each having different emission characteristics so that the electrodes pass adjacent the surface to be charged with the corona charge, while moving the rotating electrodes along the surface to be charged, a substantially uniform charge layer is applied to the surface. If the surface now is exposed to a light pattern it will discharge uniformly in accordance with the variations in intensity in the light pattern thereby creating an image appearance which is true and which is not streaked.

In the preferred embodiment, the housing completely contains member 46 so that it is in a dark environment. A shutter like apparatus (not shown) follows along behind the linear horizontal movement of corona producing device 10 allowing sections of the lighted image to be reproduced to be exposed to the sections of member 46 immediately after the corresponding sections are charged. This technique eliminates the possibility of producing a nonuniform electrostatic image as a result of variations in charge levels on the surface 48 of member 46 resulting from delayed exposure.

What it is desired to secure by letters patent of the United States is:

1. A method for charging an electrophotographic member including the steps of:

rotating a plurality of elongate corona electrodes about a central axis, each electrode extending parallel to said axis at a first predetermined distance therefrom; and applying a corona voltage to each of said rotating electrodes for developing a zone of corona about each electrode and along the length thereof whereby a plurality of substantially uniform and parallel zones of corona charge is applied to the entire electrophotographic member.

2. The method of claim 1 further including the step of moving one of said central axis and said electrophotographic member relative to the other during said rotation with a second predetermined distance being maintained between said central axis and said member whereby a substantially uniform corona charge is applied to the entire electrophotographic member.

3. The method of claim 2 wherein the step of rotating said electrodes includes the step of rotating said electrodes at a first rotational speed, and the step of moving one of said central axis and member includes the step of moving same at a second linear speed.

4. The method of claim 3 wherein each of said corona electrodes applies a corona charge to said member when adjacent thereto and wherein said step of rotating said electrodes at said rotational speed and moving one of said central axis and member at said linear speed includes the step of adjusting said speeds such that the corona charge of one of said electrodes applied to said surface overlaps a corona charge applied by a preceding electrode and is overlapped by a corona charge applied by a succeeding electrode whereby said plurality of substantially uniform and parallel zones of corona charge is applied to the entire electrophotographic member.

5. The method of claim 1 wherein the step of applying said corona voltage includes the step of simultaneously applying said corona voltage to each of said electrodes.

6. The method of claim 5 wherein the step of applying said corona voltage further includes continuously applying said corona voltage during substantially the entire period said electrodes are rotated and moved.

7. A method for charging an electrophotographic imaging surface wherein a number of elongate corona wires are positioned substantially parallel to one another and to a central axis forming a cylindrical configuration and said central axis is positioned a predetermined distance from said surface including the steps of:

developing a zone of corona surrounding each of said number of corona wires and along the entire length thereof, and rotating said number of corona wires forming said cylindrical configuration about said central axis.

8. The method of claim 7 further including the step of moving one of said central axis with said rotating corona wires forming said cylindrical configuration and said electrophotographic imaging surface relative to the other with said predetermined distance being maintained between said central axis and surface whereby said entire surface passes relative to said central axis for applying a plurality of substantially uniform zones of corona charge to said surface, and synchronizing said corona development, corona wire rotation and relative movement to occur simultaneously.

9. A corona discharge apparatus for charging an electrophotographic member including in combination:

corona producing means including a plurality of elongate spaced apart corona electrodes each having an axis extending parallel to a central axis and positioned a first predetermined distance therefrom and each developing a zone of corona along the length thereof in response to an applied corona voltage, and rotational drive means coupled to said corona producing means for rotating said electrodes about said central axis, whereby a plurality of substantially uniform and parallel zones of corona charge is applied to said member.

10. The corona discharge apparatus of claim 9 further including linear drive means coupled to one of said corona producing means and said member for moving one relative to the other during said rotation of said electrodes whereby a substantially uniform corona charge is applied to said member.

11. The corona discharge apparatus of claim 9 wherein said corona producing means include, connection means coupled to said plurality of corona electrodes for coupling a corona power supply thereto, said corona power supply being operative to supply said corona voltage to said electrodes for producing said corona.

12. The corona discharge apparatus of claim 11 wherein said corona producing means include, a rod forming said central axis, first support means seated on said rod adjacent a first end, second support means seated on said rod adjacent the other end, said corona electrodes each having one end thereof connected to said first support means and the other end connected to said second support means with said corona electrodes extending therebetween.

13. The corona discharge apparatus of claim 12 wherein said corona producing means include, mounting means mounting said rod adjacent said first and second ends, said mounting means adapted to allow rotation of said rod therein about said central axis.

14. The corona discharge apparatus of claim 12 wherein said rotational drive means are coupled to said rod for rotating said rod and said electrodes about said central axis.

15. The corona discharge apparatus of claim 14 wherein said rotational drive means are secured to said mounting means and coupled to said rod for rotating said rod and said electrodes about the said central axis.

16. The corona discharge apparatus of claim 12 wherein said corona producing means include, a housing having a top wall, first and second side walls and first and second end walls, said rod being rotatably mounted to said first end wall adjacent said rod first end and rotatably mounted to said second end wall adjacent said rod second end, said housing being constructed and arranged to allow rotation of said rod and electrodes about said central axis within said housing with said electrodes each extending beyond said housing side and end walls during a portion of rotation of each rod.

17. The corona discharge apparatus of claim 16 wherein said rotational drive means is coupled to said rod for rotating said rod and electrodes about said central axis.

18. The corona discharge apparatus of claim 16 wherein said rotational drive means are secured to said housing and coupled to said rod for rotating said rod and said electrodes about said central axis.

19. The corona discharge apparatus of claim 17 wherein said rotational drive means include a motor.

20. The corona discharge apparatus of claim 18 wherein said rotational drive means include a motor.

21. The corona discharge apparatus of claim 16 wherein said housing is electrically conductive and is coupled to ground potential.

22. The corona discharge apparatus of claim 16 wherein said housing is electrically nonconductive.

23. The corona discharge apparatus of claim 12 wherein said support means each include a plurality of fingers extending substantially perpendicular to said central axis and radially from said rod a predetermined distance and terminating at an end, said fingers of said first support means being aligned with said fingers of said second support means, each one of said plurality of elongate corona electrodes being secured to a finger of said first support means adjacent said end and to the aligned finger of said second support means adjacent the end with said electrodes extending between said fingers.

24. The corona discharge apparatus of claim 23 wherein said support means are formed from electrically conductive material.

25. The corona discharge apparatus of claim 10 wherein said corona producing means include, connection means coupled to said plurality of corona electrodes for coupling a corona power supply thereto, said corona power supply being operative to supply said corona voltage to said electrodes for producing said corona.

26. The corona discharge apparatus of claim 25 further including control circuit means coupled to said corona power supply, said rotational drive means and said linear drive means and operative upon initiation to energize said corona power supply for developing said corona voltage, to energize said rotational drive means for rotation and to energize said linear drive means for movement.

27. The corona discharge apparatus of claim 26 wherein said control circuit means include circuit means for synchronizing operation of said corona power supply, said rotational drive means and said linear drive means.

28. A corona discharge apparatus for charging an electrophotographic imaging surface including in combination;

a plurality of elongate corona discharge electrodes arranged substantially parallel with respect to one another and forming a cylindrical configuration, elongate support means for supporting said corona discharge electrodes substantially parallel with respect to one another forming said cylindrical configuration, said support means including conduction means for coupling a source of corona voltage to said plurality of elongate corona discharge electrodes said corona discharge electrodes extending parallel to said elongate support means; and first device means coupled to said support means for rotating said support means and corona discharge electrodes.

29. The corona discharge apparatus of claim 24 further including second drive means coupled to one of said support means and said electrophotographic imaging surface to move one of said corona discharge electrodes and imaging surface relative to the other across the entire electrophotographic imaging surface with a fixed distance maintained therebetween whereby a plurality of substantially uniform and parallel zones of corona charge is applied to said surface by said rotating corona electrodes.

30. The corona discharge apparatus of claim 29 wherein said conduction means is constructed and arranged to couple said corona voltage simultaneously to all said plurality of electrodes.

31. The corona discharge apparatus of claim 30 wherein said conduction means is constructed and arranged to couple said corona voltage to each of said electrodes during a portion of each rotational cycle.

32. The corona discharge apparatus of claim 30 wherein each of said electrodes apply a corona charge to said surface when rotated adjacent thereto and wherein said first drive means are constructed and arranged to rotate said support means at a first speed and, said second drive means are constructed and arranged to move said support means at a second speed said first and second speeds being selected such that the corona charge of one of said electrodes applied to said surface overlaps a corona charge applied by a preceding electrode and is overlapped by a corona charge applied by a succeeding electrode whereby a substantially uniform charge is applied to the entire electrophotographic imaging surface.

* * * * *

UNITED STATES PATENT AND TRADEMARK OFFICE

CERTIFICATE OF CORRECTION

PATENT NO. : 3,958,162
DATED : May 18, 1976
INVENTOR(S) : Manfred R. Kuehnle

It is certified that error appears in the above-identified patent and that said Letters Patent are hereby corrected as shown below:

Column 4, line 33, change "pushbotton" to -- pushbutton --.

Column 5, line 20, change "overlappig" to -- overlapping --.

Column 8, line 37, change semi-colon (;) to a comma (,).

Column 8, line 39, change "device" to -- drive --.

Signed and Sealed this

Fifteenth Day of March 1977

[SEAL]

*Attest:*

RUTH C. MASON
*Attesting Officer*

C. MARSHALL DANN
*Commissioner of Patents and Trademarks*